United States Patent [19]

Mazzorana

[11] 4,294,129

[45] Oct. 13, 1981

[54] CONTROL LEVER OF ELECTRICAL STARTER

[75] Inventor: Alfred B. Mazzorana, Venissieux, France

[73] Assignee: Societe de Paris et du Rhone, Lyons, France

[21] Appl. No.: 24,212

[22] Filed: Mar. 19, 1979

[30] Foreign Application Priority Data

Jul. 29, 1977 [FR] France ..... 77 24135

[51] Int. Cl.[3] ..... F02N 11/00

[52] U.S. Cl. ..... 74/7 A; 74/6

[58] Field of Search ..... 74/6, 7 R, 7 A; 290/38 A

[56] References Cited

U.S. PATENT DOCUMENTS

| | | | |
|---|---|---|---|
| 2,579,102 | 12/1951 | Thornburg et al. | 74/6 X |
| 2,839,935 | 6/1958 | Hartzell et al. | 290/38 A |
| 3,020,771 | 2/1962 | Redick et al. | 74/7 |
| 3,104,302 | 9/1963 | Williams | 200/166 |
| 3,304,790 | 2/1967 | Takami | 74/6 |
| 4,116,077 | 9/1978 | Mazzorana | 74/7 A |

FOREIGN PATENT DOCUMENTS

| | | | |
|---|---|---|---|
| 2548358 | 10/1975 | Fed. Rep. of Germany | 74/7 A |
| 1401410 | 4/1965 | France . | |
| 1501390 | 10/1967 | France . | |
| 2331694 | 10/1977 | France . | |
| 602368 | 5/1946 | United Kingdom . | |
| 992727 | 5/1965 | United Kingdom . | |
| 1368248 | 9/1974 | United Kingdom . | |

*Primary Examiner*—Allan D. Herrmann

*Attorney, Agent, or Firm*—Dowell & Dowell

[57] ABSTRACT

A control lever assembly for the actuator of a starter for internal combustion engine, the pivoting of which is effectuated by means of a member which is hinged freely with respect to said lever, said member being provided with two heads comprising each a convex lateral surface which cooperates with complementary recess of the casing of said starter.

4 Claims, 6 Drawing Figures

CONTROL LEVER OF ELECTRICAL STARTER

The present invention relates to improvements in the control lever assembly of the actuator of an electrical starter.

Starters functioning with the aid of such a lever present at the front of the armature of large casing enclosing an inner compartment in which are housed the lever and its actuating members.

The improvements forming the subject matter of the present invention allow the dimensions of a starter provided with a pivoting lever for activating its actuator to be considerably reduced, whilst ensuring an excellent functioning of its return spring.

The invention will be more readily understood on reading the following description with reference to the accompanying drawings, in which.

Figure 1:
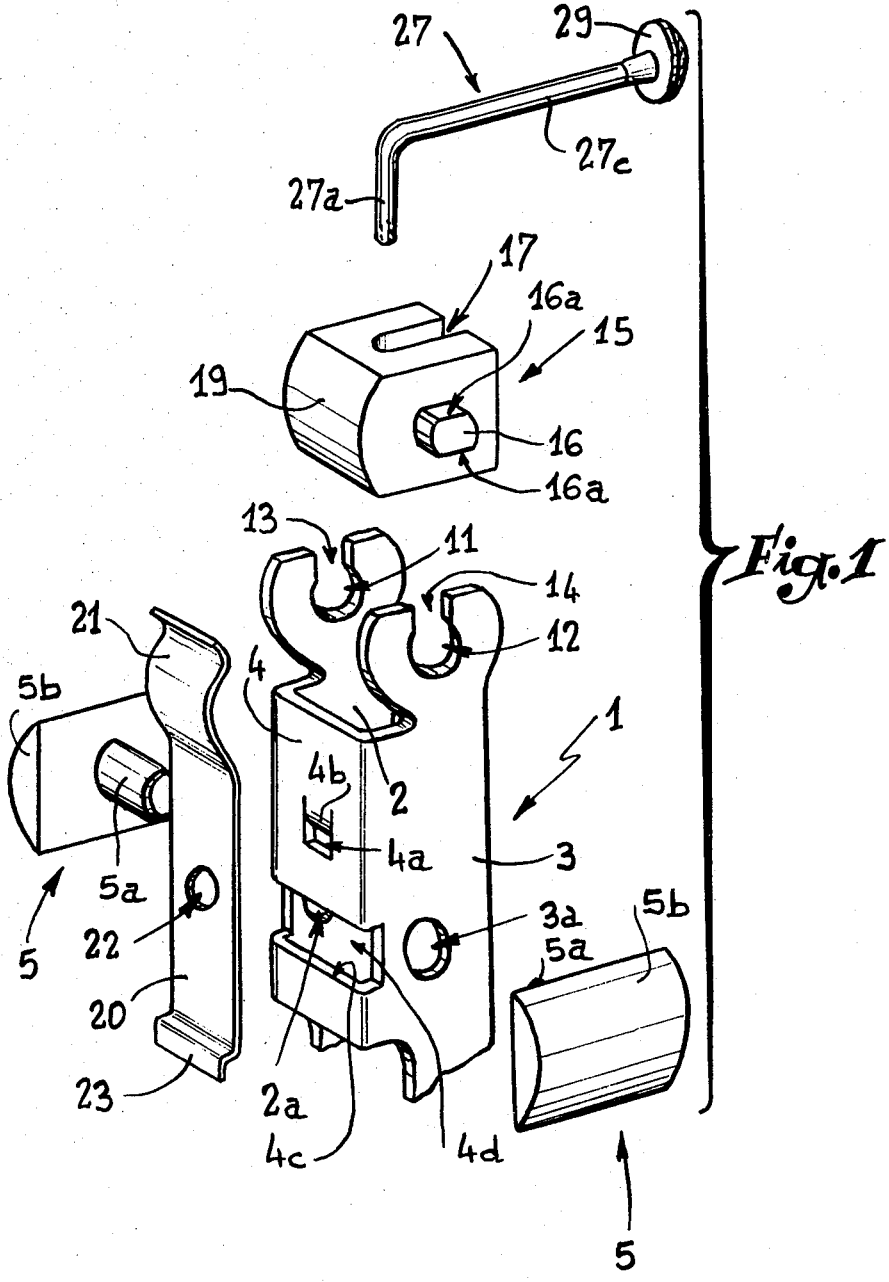
FIG. 1 is an exploded view of the upper part of a lever activating a starter actuator established in accordance with the invention.

Referring now to the drawings, FIG. 1 shows the upper part of the lever 1 for operating the conventional actuator of an electrical starter used for starting an internal combustion engine.

According to the invention, this lever is made from a sheet metal blank folded on itself. It comprises two flat, parallel arms 2, 3 connected over a small part of their height by a transverse web 4. In other words, over this height, the lever 1 has a U-shaped transverse section.

It will be noted that the web 4 comprises in its top part a "slash" 4*a* which provides a catch 4*b* oriented perpendicularly to said web and located between the arms 2 and 3, parallel thereto.

In the bottom part of the web 4, each of the arms 2, 3 is provided with holes 2*a*, 3*a* adapted for the passage of the cylindrical body 5*a* of a rivet 5 of which the head 5*b* is rectangular in shape, with convex top. The length of the body 5*a* of each rivet is such that, when the ends of said bodies are in contact, the distance between the underpart of the two heads 5*b* is slightly greater than the width of the lever 1 so that there is no risk of binding of said lever. The length of the head 5*b* of each rivet is greater than that of the arms 2, 3 of the lever 1 so that their end edges project on either side of these arms for reasons which will be explained hereinbelow.

Figure 2:
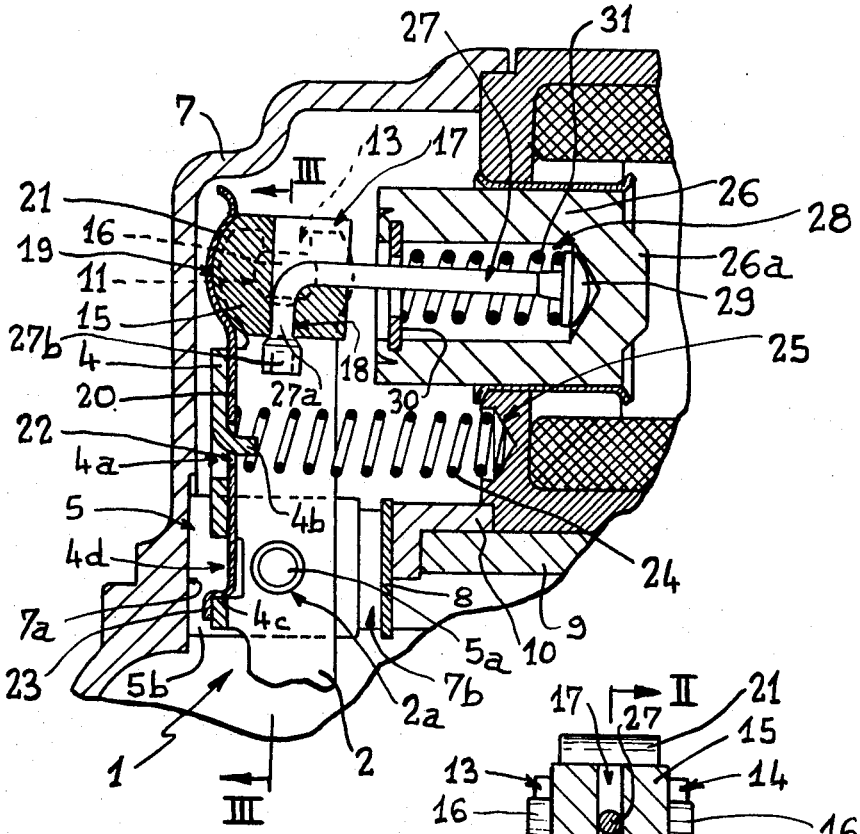
FIG. 2 is a partial longitudinal section through a starter of reduced dimensions due to the use of a lever according to the invention.
Figure 3:
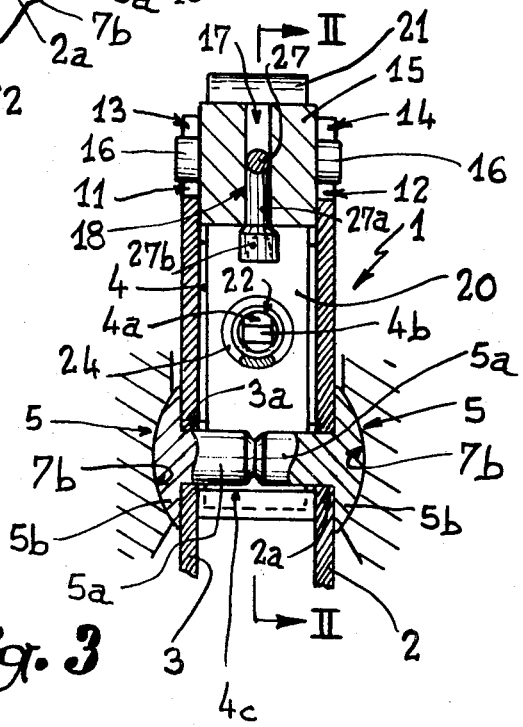
FIG. 3 is a section thereof along III—III (FIG. 2). The plane of section II—II of FIG. 2 has been shown in this view.

As shown in FIGS. 2 and 3, when the lever 1 is in place, the side surfaces of the heads 5*b* of the rivets 5 are adapted to abut on the one hand against a bearing surface 7*a* made on the inner face of the partition 7 of the nose of the starter and on the other hand against a stop 8 fixed to the solenoid inductor 9 of the starter via a spacer 10 acting as seal. The bearing surface 7*a* and the stop 8 are oriented vertically, i.e. parallel to the corresponding edges. It will be readily understood that the heads 5*b* are convex so as to cooperate, with a view to their guiding, with depressions 7*b* made in the nose 7 of the starter and located facing each other (FIG. 3).

Each of the ends of the arms 2, 3 is in the form of a fork and these forks are formed by a central perforation 11, 12 which opens out via a passage 13, 14 of width smaller than the diameter of the corresponding perforation.

The above-mentioned fork is adapted to cooperate with an arcuate member comprising a block 15 and more particularly with two pivot pins 16 on said latter located in opposition on each of its side faces. Each pivot pin is in the form of a cylinder provided with two flat parts 16*a* separated by a distance smaller than the width of each passage 13, 14. The cylindrical part of each pivot pin has a diameter slightly smaller than that of the perforations 11, 12 of each arm 2, 3. By pivoting the block 15 so that its flat parts are vertical, the pivot pins 16 may be introduced in the above-mentioned perforations so that, after a further rotation through 90°, the block becomes prisoner of the lever 1 but remains free to pivot. It will be noted that the block 15 is provided with a longitudinal notch 17 at the end of which opens a vertical hole 18 (FIG. 2) and that one of its end faces 19 is convex in shape.

There is provided to associate with the lever 1 a spring blade 20 of which one of the ends 21, is bent so as to be able to be applied against the convex face 19 of the block 15 so as to maintain its pivot pins in abutment against the circular part of each of the perforations 11, 12 which are located opposite the convex face 19 of this block. The blade 20 further comprises a hole 22 whilst its end 23, opposite end 21, is offset in a direction inverse of the bend of said end 21. As shown in FIG. 2, the blade 20 cooperates with the inner face of the web 4 of the lever 1, the catch 4*b* of which passes through the hole 22. As indicated above, the end 21 of the blade abuts against the convex face 19 of the block 15, whilst its end 23 straddles the lower edge 4*c* of a transverse opening 4*d* made in the web 4 at the level of holes 2*a*, 3*a*.

It will be noted that the catch 4*b* constitutes a centering means for one of the ends of a compression spring 24, the other end of which is retained by an impression 25 made in the body of the solenoid.

It is conventionally provided to actuate the lever 1 by means of a solenoid of which the core 26 is associated with a bent rod 27 (FIGS. 1 and 2). The bent end 27*a* of this rod passes through the notch 17 and engages in the hole 18 of the block 15 beyond which it projects. The part 27*b* projecting beyond the block 15 enlarges so that the rod 27 is fast with the bottom of the notch 17 of the block 15. The rectilinear part 27*c* of the rod 27 is disposed inside a blind bore 28 made in the core 26 and against the conical bottom of which it rest via a convex head 29 as explained hereinbelow. A washer 30 is crimped at the level of the opening of the bore 28 so as to constitute a stop for one of the ends of a compression spring 31, the other end of which abuts against the underpart of the head 29 to apply it elastically against the bottom of the bore 28. It will be noted that the washer 30 comprises an opening whose dimensions are sufficient so as not to hinder the movement of the rod 27 during operation.

It is observed that the end of the core 26 opposite the lever 1 comprises a male conical frustum 26*a* which makes it possible, without dangerously reducing the thicknesses, to provide a maximum length for the bore 28 and consequently to use a spring whose working load is not too high.

Operations follows from the preceding explanations:

At rest the lever 1 is in the position shown in FIG. 2, i.e. it is pushed by the spring 24 so that the left end edge of the rivets 5 rests against the bearing surface 7*a* of the partition 7 of the nose of the starter. The rod 27 maintains the core 26 of the solenoid outside its winding.

If the latter is energized, the core 26 moves towards the right in FIG. 2, it brings about a subsequent displacement of the rod 27 so that the lever 1 pivots against the reaction of the spring 24 until the gear controlled by the actuator bears against the lateral face of the large flywheel ring. The spring 31 is of course compressed, this ensuring a pressure between the end of the teeth of the gear and the large ring. After the teeth of the gear have meshed with those of the large ring, and the power to the winding of the solenoid has been cut, the reaction of the spring 24 returns the assembly into the position of FIG. 2. It will be noted that during these movements, the blade 23 damps movement of the pivot pins of the block in the central perforations 11, 12 of the arms of the lever 1 whilst allowing its pivoting.

Figure 4:
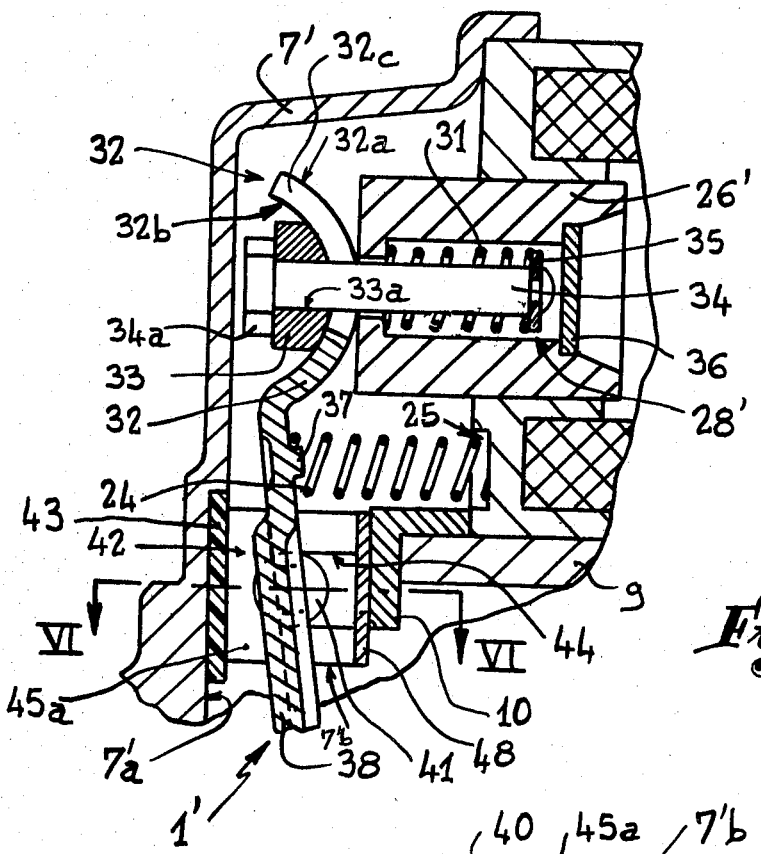
FIG. 4 is a view similar to that of FIG. 2, but showing a variant embodiment.

As shown in FIG. 4, the lever may, according to a variant, take the form of a suitably shaped flat iron. This lever, referenced 1', is provided with an arcuate member comprising the upper rounded end 32 whose convex face 32*a* is in abutment against the outer end of the mobile core 26' of the electrocontactor, whilst its inner concave face 32*b* cooperates with a pad 33 of similar shape. The rounded end 32 of the lever 1' is further provided with a central slot 32*c* through which a rod 34 passes. Said rod also engages in a central hole 33*a* in the pad 33 and penetrates in a blind bore 28' arranged in the core 26'. A head 34*a* of the rod 34 rests against the flat outer face of the pad 33 whilst the opposite end of the rod 34 is riveted on a washer 35 which maintains the spring 31 compressed against the bottom of the bore 28'. A cap 36 closes the opening of the bore 28'.

Due to the above described arrangement, the lever 1' is constantly in elastic abutment against the corresponding end of the mobile core of the electro-contactor via the "tooth against tooth" spring 31 and the pad 33. The assembly therefore constitutes an anti-vibratory device for the lever 1'.

It is observed that the lever 1' is provided with a projection 37 adapted for centering the spring 24, which projection may be obtained simply by punching. The median part of the lever 1' is further provided with a longitudinal pressing 38 adapted to reinforce it.

Figure 5:
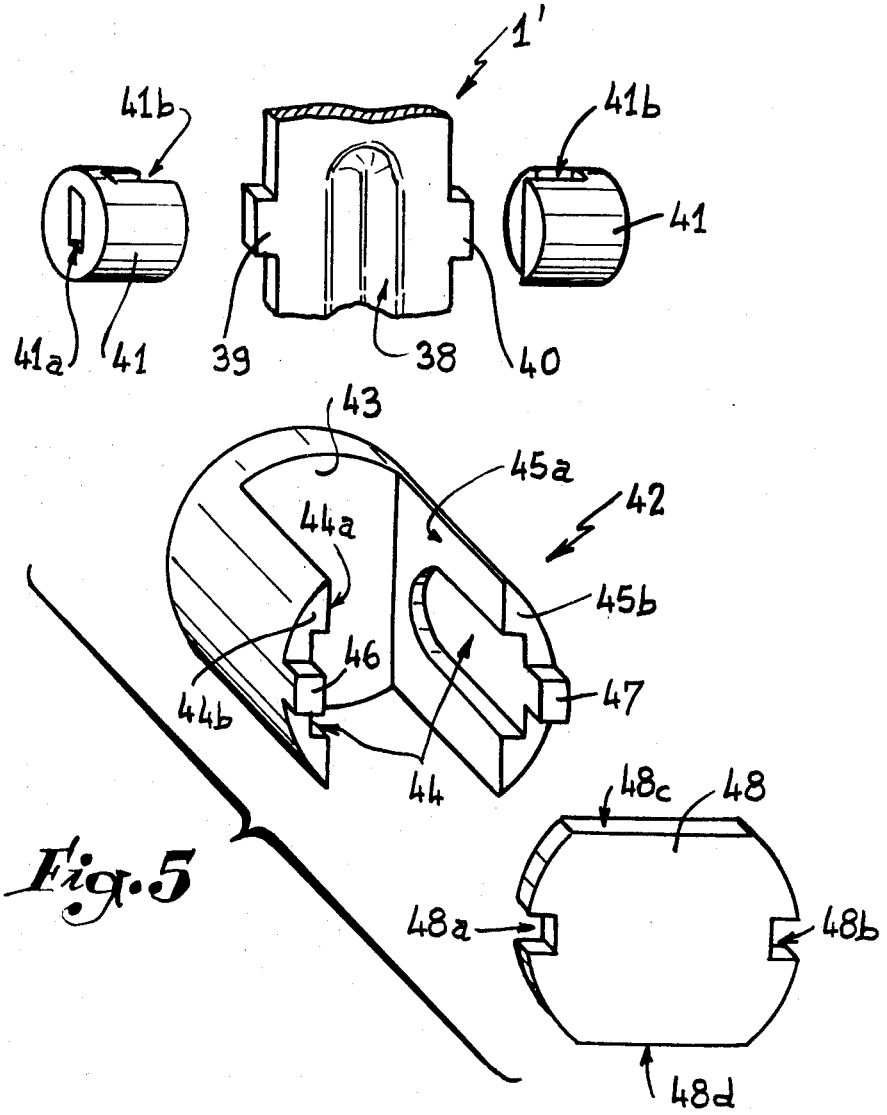
FIG. 5 is an exploded view of the different elements intended to allow the pivoting of the lever according to the variant.

As shown in FIG. 5, the median part of the lever 1' is further provided with two lateral lugs 39, 40 adapted to allow its pivoting. These lugs each engage without noteworthy clearance in the central hole 41*a* of a generally cylindrical pivot pin 41. Each pivot pin is provided with a radial slot 41*b* which enables it to partially straddle the lever 1' at the level of each of its lugs. It will further be noted that each pivot pin is truncated on one side only of its slot 41*b* so that it escapes the pressing 38 (FIG. 6).

It is provided to place in the depression 7'*b* of the partition 7' of the nose of the starter according to the invention, a U-shaped block member 42 whose transverse web 43 is circular so that it may engage in the above-mentioned depression and rest against the bearing surface 7*a* of the partition 7'. The inner face 44*a*, 45*a* of each of the arms of the block 42 is provided with a longitudinal groove 44 of which the width is equal, apart from the clearance, to the diameter of each pivot pin 41 and of which the bottom is rounded. It is noted that the two grooves 44 open out on the end face 44*b*, 45*b* of each arm of the block 42. These end faces each comprise a lug 46, 47 of square or rectangular form. A plate 48 made in the form of a portion of circle of diameter equal to that of the web 43 is place against the end faces 44*b*, 45*b* of the arms of the block 42. It comprises, of course, two notches 48*a*, 48*b* in which are respectively housed the lugs 46, 47 of the block. The two flat parts 48*c*, 48*d* of the plate 48 are separated by a distance equal to the height of each of the arms of the block 42.

Figure 6:
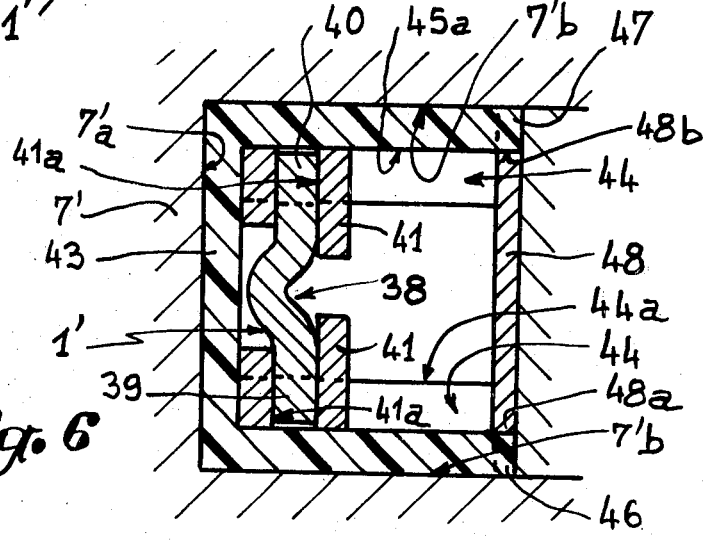
FIG. 6 is a section along VI—VI (FIG. 4).

To effect assembly of the lever 1' according to the variant of FIGS. 4 to 6, the lugs are firstly engaged in the pivot pins 41, then said latter are fitted in the grooves 44 until they abut in their rounded bottom which comprises the same radius, then the plate 48 is placed in position so that its notches cooperate with the lugs 46, 47 the whole is finally engaged in the depression 7'*b* of the partition 7' of the nose of the starter. As shown in FIG. 4 it is the spacer 10 provided to be made of rubber which maintains the plate 48 in position and the block 42 against the bearing surface 7'*a*. The block is advantageously made of plastics material whilst the support plate is provided to be made of metal. It will be readily appreciated that this latter avoids the two arms of the block moving towards each other and that it allows a better abutment of the spacer 10 against the block 42 to be obtained.

When the electro-contactor of the starter is actuated, the lever 1' pivots in the grooves 44 via its added pivot pins 41, its displacement parallel to the axis of the actuator being effected by sliding of the pivot pins in the grooves 44.

A general arrangement has thus been produced which enables the dimensions in length of an electric starter for internal combustion engine to be substantially reduced, this subsequently leading to a noteworthy saving in weight.

It must be understood that the preceding specification has been given only by way of example and that it in no way limits the domain of the invention, the scope of which would not be exceeded if the details of execution described were replaced by any equivalent ones.

In particular, the cylindrical body 5*a* of each rivet 5 could be eliminated and replaced by a perforation whilst each arm of the lever would comprise a cylindrical lug engaging in the perforation of the corresponding rivet and which would be located at the place of the hole 3*a* in question.

I claim:

1. A control lever assembly for a starter for an internal combustion engine, the assembly being supported in a starter casing and the lever having one end cooperating with the core of a starter solenoid and having a second end actuating a starter gear, the assembly comprising:

(a) an elongated lever arm extending between said two ends and comprising two flat arm portions disposed normal to said pivot means and joined together by a web portion extending transversely therebetween;

(b) the casing having internal depressions disposed transversely of the lever intermediate its ends;

(c) pivot means located in and extending across said depressions and pivotally supporting the lever in the casing; and said pivot means comprising two rivet members each having a head shaped to fit into a depression in the casing and each having a cylindrical body portion extending through a pivot hole in an arm portion;

(d) said one end of said lever having an arcuate member located thereat; and (e) rod means pivotally connected to the lever at said arcuate member and extending toward and coupled to said core to pivot the lever when the solenoid is actuated.

2. A control lever as claimed in claim 1, wherein the arcuate member at said one end of the lever is pivotally attached to the arm and has a convex face extending away from said rod means, and wherein the assembly further includes a spring blade attached to said web portion and having an arcuate end pressing against said convex face of the arcuate member; and wherein the assembly includes a lever-return spring compressed in the casing and bearing against the web portion of the lever.

3. A control lever assembly for a starter for an internal combustion engine, the assembly being supported in a starter casing and the lever having one end cooperating with the core of a starter solenoid and having a second end actuating a starter gear, the assembly comprising:

(a) an elongated lever arm extending between said two ends;

(b) the casing having internal depressions disposed transversely of the lever intermediate its ends;

(c) pivot means located in and extending across said depressions and pivotally supporting the lever in the casing;

(d) said one end of said lever having an arcuate member located thereat; and (e) rod means pivotally connected to the lever at said arcuate member and extending toward and coupled to said core to pivot the lever when the solenoid is actuated, said arcuate member at said one end of the lever comprising an arcuate end of the lever having a concave face facing away from said core, said rod means extending from the core through the arm, and the assembly further comprising a pad shaped to fit said concave face, the pad being fixed to the rod on the other side of the lever from the core.

4. A control lever as claimed in claim 3, wherein the assembly further includes in the casing a lever-return spring offset from the pivot of the lever and compressed against the lever, and the lever having means for centering the spring where it contacts the lever.

* * * * *